US006026515A

United States Patent [19]

Nielson et al.

[11] Patent Number: 6,026,515

[45] Date of Patent: Feb. 22, 2000

[54] JEWELRY ARTICLE HAVING DUAL FASTENERS FOR SECURING TO A GARMENT

[75] Inventors: David Nielson, Oviedo; Karalyn Viers, Orlando, both of Fla.

[73] Assignee: Z Jewelry, Inc., Winter Park, Fla.

[21] Appl. No.: 08/926,354

[22] Filed: Sep. 9, 1997

[51] Int. Cl.[7] ..... A41D 27/08

[52] U.S. Cl. ..... 2/244; 63/1.11; 63/3; 63/21; 63/23; 150/134; 2/314; 2/319

[58] Field of Search ..... 63/1.11, 1.12, 63/1.14, 1.18, 3, 3.1, 4, 21, 22, 23, 24, 33, 38; 24/3.1, 3.13, 3.6, 299, 905; 150/102, 134; 2/243.1, 244, 245, 300, 321, 311, 320, 312, 313, 314, 319

[56] References Cited

U.S. PATENT DOCUMENTS

| | | | |
|---|---|---|---|
| 520,053 | 5/1894 | Hopkins | 24/3.13 X |
| 633,092 | 9/1899 | Bigney . | |
| 741,564 | 10/1903 | Summa | 63/21 |
| 744,933 | 11/1903 | Nicholson | 224/674 |
| 815,277 | 3/1906 | Facette | 224/587 |
| 890,530 | 6/1908 | Ross | 24/299 X |
| 1,059,603 | 4/1913 | Fritz | 2/304 |
| 1,155,032 | 9/1915 | Baer . | |
| 1,520,395 | 12/1924 | Becker | 24/3.13 |
| 1,552,156 | 9/1925 | Heller . | |
| 1,566,206 | 12/1925 | Greene | 2/309 |
| 1,575,182 | 3/1926 | Shiba | 24/3.13 |
| 1,688,506 | 10/1928 | Rivers | 24/3.13 |
| 1,922,594 | 8/1933 | Lippstadt . | |
| 2,004,247 | 6/1935 | McCaul | 24/299 X |
| 2,042,808 | 6/1936 | Seebeck . | |
| 2,065,831 | 12/1936 | Smith | 24/299 |
| 2,084,151 | 6/1937 | Leitner | 63/3.1 |
| 2,236,207 | 3/1941 | Bowder | 24/3.13 X |
| 2,250,328 | 7/1941 | Daniels . | |
| 2,362,732 | 11/1944 | Tarbox | 2/321 |
| 2,408,688 | 10/1946 | Schonthal . | |
| 2,663,026 | 12/1953 | Arnold | 2/229 |
| 2,707,285 | 5/1955 | Tino | 24/299 X |
| 2,783,926 | 3/1957 | Wise | 150/102 X |
| 2,852,825 | 9/1958 | Ballou, Jr. . | |
| 3,163,026 | 12/1964 | Kenny | 63/21 X |
| 3,804,307 | 4/1974 | Johnston | 63/3 X |
| 3,822,446 | 7/1974 | Silverstein . | |
| 4,651,989 | 3/1987 | Wilson | 473/502 |
| 4,885,805 | 12/1989 | Mason | 2/244 |
| 5,044,049 | 9/1991 | Owens et al. . | |
| 5,070,581 | 12/1991 | Senter . | |
| 5,497,818 | 3/1996 | Marcarelli | 150/134 |
| 5,797,145 | 8/1998 | Levinson | 2/244 |

FOREIGN PATENT DOCUMENTS

| | | | |
|---|---|---|---|
| 309395 | 4/1929 | United Kingdom | 24/299 |

*Primary Examiner*—Terry Lee Melius
*Assistant Examiner*—Andrea Chop
*Attorney, Agent, or Firm*—Allen,Dyer,Doppelt, Milbrath & Gilchrist,P.A.

[57] ABSTRACT

An article of jewelry attaches to a garment which has a belt loop and a fly closure. The article includes a fly closure fastener adapted to be secured to the fly closure of the garment, a belt loop fastener having an opening and adapted to be positioned over the belt loop of the garment, a first elongate flexible member connecting the fly closure fastener and the belt loop fastener together, and a second elongate flexible member connecting an ornamental body or pouch to the belt loop fastener. The fly closure fastener is typically a closed loop, and may have an openable portion. The belt loop fastener may have a flat base portion and depending branches. In addition, the branches may converge to define a narrower opening to secure the fastener to the belt loop. The elongate flexible members may be provided by chains or strands.

28 Claims, 3 Drawing Sheets

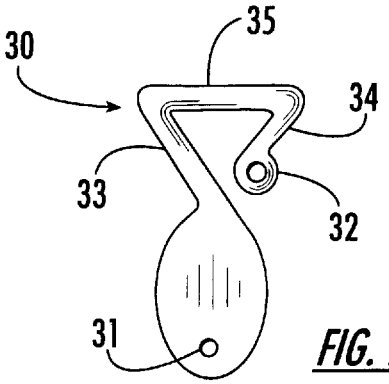
FIG. 7.
FIG. 8.
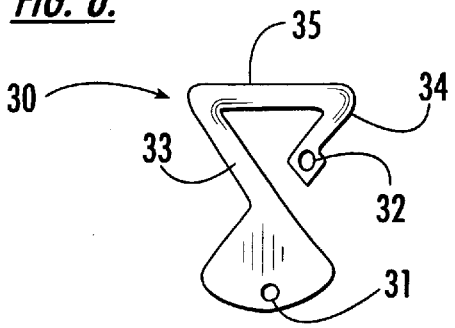
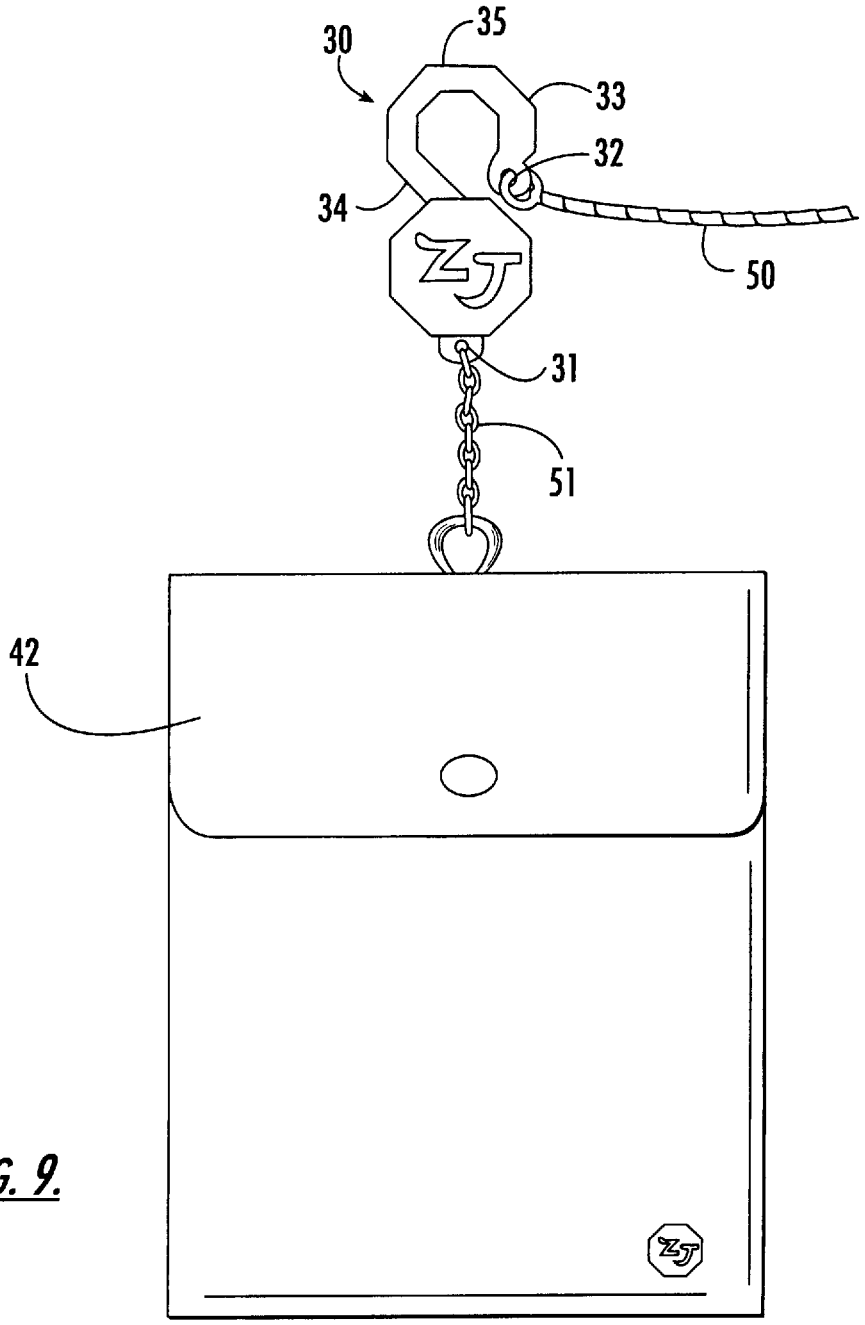
FIG. 9.

JEWELRY ARTICLE HAVING DUAL FASTENERS FOR SECURING TO A GARMENT

FIELD OF THE INVENTION

The present invention relates to the field of jewelry, and, more particularly, to jewelry that can be attached to a garment.

BACKGROUND OF THE INVENTION

There are numerous well known methods for attaching ornamental items such as articles of jewelry to the clothing of the wearer. Such methods include pins, clasps or rings which may be used to attach ornaments to flexible materials such as chains, strands or cords. There are also numerous well-known means for securing other items, such as keys or pouches for holding valuables, to the clothing of the wearer as well. This may be accomplished by means of a clip or clasp for attaching the keys or pouch to the belt or belt loop of the wearer, or a clip or clasp which connects the belt or belt loop of the wearer by means of a chain.

It is also known that individuals who may wish to not carry a purse, handbag or wallet may wish to carry important items, such as a driver's license, credit card or cash in the pouch of a belt worn around the waist (commonly referred to as a "fanny pack"). Such devices are merely fastened around the waist of the owner by means of a belt or clasp. As the valuables themselves are not attached to the clothing of the wearer, the belt and the entire contents of the pouch could easily be dislodged from the person.

Various devices which secure ornamental items such as jewelry or valuables to the clothing of the person are known in the prior art. For example, U.S. Pat. No. 633,092 to Bigney discloses a pocket watch chain adapted to secure the pocket watch to an article of clothing by means of a bar to be fitted through a button hole. Bigney also discloses an ornamental device attached to the watch chain.

U.S. Pat. No. 2,042,808 to Seebeck discloses a safety chain by which an article of jewelry, pocket watch or other item of value may be secured to the clothing of its owner. This is accomplished by means of a chain with an elongated guide ring at one end which allows the other end of the chain to be threaded through the guide ring to form a loop. The loop is secured through a button hole or around a belt or belt loop with a fastener at the free end of the chain for attaching to the article of value. However, this device may only be detached from a belt loop by first detaching the item of value from the connecting chain in its entirety, and then removing the entire chain from within the elongated guide ring.

U.S. Pat. No. 2,408,688 to Schonthal discloses a device for securing the zipper on a pocket of a pair of trousers. This is accomplished by attaching one end of a chain of limited length to the ear of the zipper and the other end of the chain to a snap button. The length of the connecting chain is limited so that when the zipper is pulled to a closed position and the snap button engaged into a snap button base sewn onto the garment, the zipper cannot be opened without detaching the snap button from its base.

U.S. Pat. No. 1,922,594 to Lippstadt discloses a ring for attaching articles to clothing, comprised of a one-piece flat pear-shaped metal spring ring, which is split at its narrow portion so that it may be attached to a belt-loop, belt or button hole. Once this ring is attached, the ends of the ring are closed together by a clasp. This clasp also contains a ring at its wide portion for attaching a chain which may, in turn, be connected to a key ring or pocket watch.

A review of the prior art disclosed above indicates that while there have been attempts for securing valuables to an article of clothing through rings which attach on or around a button, button hole or belt loop, there remain inherent problems with each one. As described above, such devices provide for only one location for securing the article to the wearer's clothing. Moreover, the systems for securing articles of value to the clothing of the wearer as defined in the prior art are either cumbersome to attach or difficult to remove.

SUMMARY OF THE INVENTION

In view of the foregoing background, it is therefore an object of the present invention to provide an article of jewelry having more than one fastener for securing a valuable ornamental body, such as an ornament or a pouch, to a garment of the wearer.

It is another object of the invention is to provide an article of jewelry that is readily fastened and removed from the garment.

These and other objects, features and advantages in accordance with the present invention are provided an article of jewelry for attaching to a garment of a type comprising a belt loop and a fly closure, such as a pair of trousers or a skirt. The article of jewelry preferably comprises a fly closure fastener adapted to be secured to the fly closure of the garment, a belt loop fastener having an opening and adapted to be positioned over the belt loop of the garment, a first elongate flexible member connecting the fly closure fastener and the belt loop fastener together, an ornamental body or item of value, and a second elongate flexible member connecting the ornamental item to the belt loop fastener. The article of jewelry thus provides a dual approach for securing the ornamental body to the garment, in an attractive and straightforward fashion, and which is readily attached and removed.

The fly closure fastener preferably comprises a closed loop, and may also include an openable portion. In addition, the fly closure fastener also preferably includes an eyelet portion connected to the first elongate flexible member. At least one of the first and second elongate flexible members may be provided by a chain or a strand, for example.

The belt loop fastener preferably comprises a base portion defining a generally flat contacting surface for the belt loop and a pair of branch portions depending from the base portion. The pair of branch portions may also desirably have opposing free ends defining an opening narrower than a width of the base portion to thereby secure the belt loop within the belt loop fastener. Each of the pair of branch portions preferably has an eyelet portion at the free end thereof. Accordingly, the first flexible elongate member is preferably connected to one of the eyelet portions, and the second flexible elongate member is preferably connected to the other eyelet portion.

The ornamental body may be a medallion, for example. In addition, the ornamental body may also be a pouch which can also be used to carry small objects.

BRIEF DESCRIPTION OF THE DRAWINGS

FIG. 7 is a front elevational view of another embodiment of the belt loop fastener in accordance with the present invention;

FIG. 8 is a front elevational view of another embodiment of the belt loop fastener in accordance with the present invention; and FIG. 9 is a front elevational view of another embodiment of the belt loop fastener and of an ornamental body in the form of a pouch attached to the belt loop fastener in accordance with the present invention.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
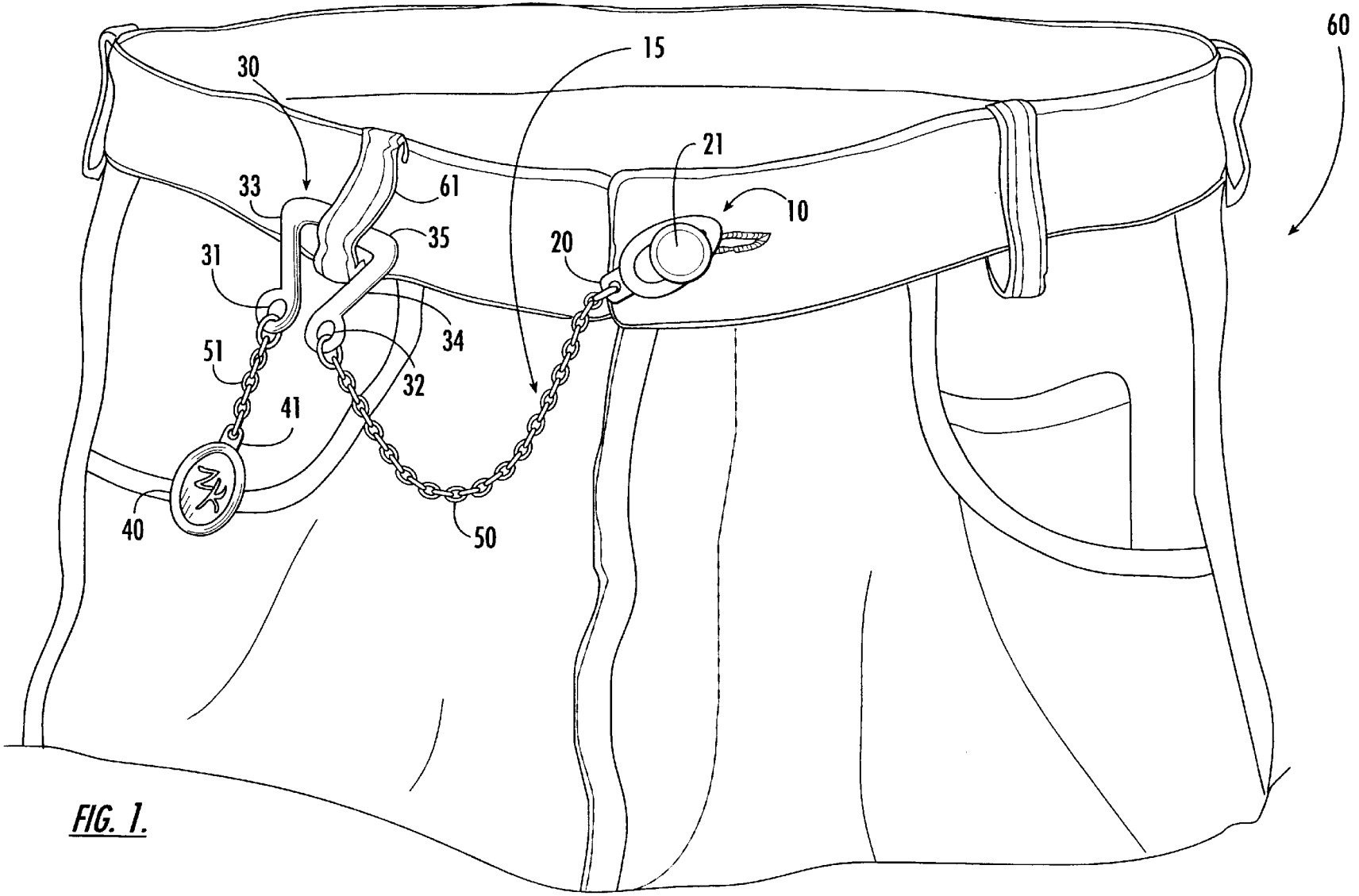
FIG. 1 is a front elevational view of an embodiment of the article of jewelry on a pair of trousers in accordance with the present invention.
Figure 2:
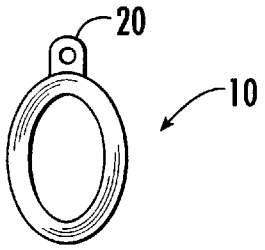
FIG. 2 is a front elevational view of the fly closure fastener of the article of jewelry as shown in FIG. 1.
Figure 3:
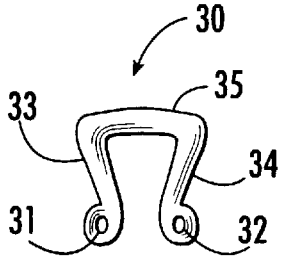
FIG. 3 is a front elevational view of the belt loop fastener as illustrated in FIG. 1.
Figure 4:
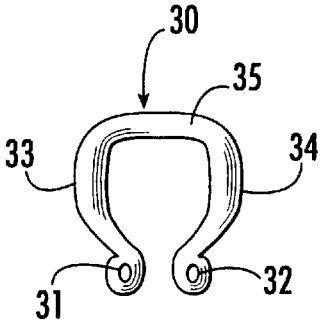
FIG. 4 is a front elevational view of an alternative embodiment of the belt loop fastener in accordance with the present invention.
Figure 5:
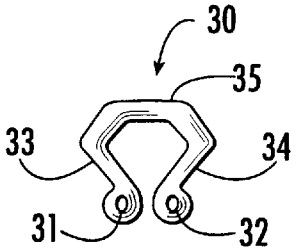
FIG. 5 is a front elevational view of yet another alternative embodiment of the belt loop fastener in accordance with the present invention.

Referring initially to FIGS. 1–3, the article of jewelry 15 in accordance with the present invention is first described. The article 15 illustratively includes a generally oval shaped fly closure fastener 10 having an eyelet portion 20, two elongated flexible members 50 and 51, a belt loop fastener 30, and an ornamental body in the form of a medallion 40. In the illustrated embodiment, the fly closure fastener 10 is generally in the form of a closed loop of sufficient dimensions so as to be readily slipped around a fly closure button 21 of garment 60 so the narrow portion of the fastener is secured about the shank of the button.

The fastener 10 may be made of metal or precious metal approximately 2.55 mm in width and 1.024 mm thick. The eyelet portion 20 of the fastener 10 provides an attaching point for attaching an end of the first elongated flexible member 50 to the fly closure fastener. The fly closure fastener 10 may also take other forms and shapes, but is preferably a closed loop. In other embodiments, the closed loop may include an openable portion as would be readily understood by those skilled in the art.

Referring now more particularly to FIG. 3, the illustrated belt loop fastener 30 comprises a base portion 35 defining a generally flat surface for resting upon the belt loop 61, and two coverging branch portions 33 and 34 which depend from the base to define an opening narrower than the width of base. This allows the belt loop fastener 30 to be secured about belt loop 61 with the base 35 resting upon the belt loop, and with the narrower opening defined by the free ends of the branches serving to capture the belt loop.

One of the converging branch portions 34 of the belt loop fastener 30 includes an eyelet portion 32 to permit the attachment of the opposite end of the first elongated flexible member 50. Similarly, the other converging branch portion 33 of the belt loop fastener 30 also includes an eyelet portion 31, which allows for attachment of the second elongated flexible member 51 to the belt loop fastener.

As shown in the illustrated embodiment shown in FIG. 1, the opposite end of second elongate flexible member 51 is attached to an ornamental body, such as the medallion 40 by means of an eyelet portion 41. As would be readily understood by those skilled in the art, the ornamental body may take many shapes and forms. For example, as shown in the embodiment shown in FIG. 9, the ornamental body may comprise a pouch 42 for use in holding money, a driver's license, credit cards or other small items of value. Thus, the wearer would obtain the same advantage of having the purse secured by the dual securing system provided by the present invention.

Referring again to FIG. 1, in the preferred embodiment, the fly closure fastener 10 is secured to the button 21 of a fly of a garment such as a pair of trousers 60 or a shirt. The belt loop fastener 30 is engaged by slipping the opening formed by converging base portions 33 and 34 over the belt loop 61 in order that base 35 may make contact upon belt loop, with the first flexible elongate member 50 linking the fly closure fastener 10 to the belt loop fastener 30 through eyelet 32. The medallion 40, which is secured to eyelet 31 of the other converging base portion 33 by means of the second flexible elongate member 51, is permitted to dangle freely, such that the weight of medallion may assist in holding the belt loop fastener in a secure position. Thus, when properly engaged, the present invention provides that medallion 40 is secured to the garment of the wearer by means of both the second flexible elongate member 51 and the belt loop fastener 30, as well as first flexible elongate member 51 and the fly closure fastener 10, therefore providing a dual security attachment. Should either the fly closure fastener 10 or belt loop fastener 30 become detached or dislodged, the remaining security device would still act to secure the medallion 40 to the wearer. Further, having secured the jewelry article to the trousers by means of belt loop fastener 30, the wearer may freely detach fly closure fastener 10 to unbutton the trousers or to adjust the placement of the fly closure fastener without fear that the medallion may become dislodged. Moreover, in the event that the belt loop 61 were to break free from garment 60, the medallion 40 would remain attached to garment 60 by means of the fly closure fastener 10.

In all of the embodiments of the belt loop fastener as shown in FIGS. 2 through 5 and 7 through 9, the belt loop fasteners 30 comprise a generally flat base portion 35, two converging branch portions 33 and 34 which depend from base 35 to define an opening narrower than the width of base 35 and eyelet portions 31 and 32 for securing the two elongated members thereto. However, even in the alternative embodiments shown in FIGS. 7 through 9, where the lower segment of converging branch portion 33 may be sufficiently wide in order to accommodate a decorative design or feature, the other elements of the belt loop fastener, such as the presence of eyelet 31 for attaching the second elongated fastening member 51, remain as described.

The flexible elongate members 50 and 51 may comprise a chain of small gauge made of metal or precious metal. They may also be comprised of any other type of flexible material, such as leather, plastic or hemp, which may be formed into a strand. In the preferred embodiment, member 50 may also be of greater length than member 51.

Figure 6:
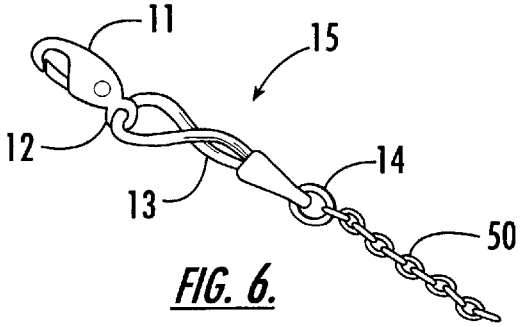
FIG. 6 is a front elevational view of an alternative fly closure fastener in accordance with the present invention.

In an alternative embodiment depicted in FIG. 6, the fly closure fastener 10 may be in the form of a closed loop device 15 comprising a common miniature snap 11 with an eyelet portion 12. A flexible strand 13 may be threaded through the eyelet portion 12 and ring 14, with the ring adapted to be attached to the flexible elongate member 50, thereby providing a snap means for attaching the present invention to the ear segment of the zipper of a "fly" of a garment. To accomplish this, one would simply snap clip 11 to the open end of the ear of the zipper. As such, this embodiment would secure the present invention to the garment of the wearer, but would not impede raising or lowering of the zipper. In an alternative embodiment (not pictured), the miniature snap 11 could be secured directly to flexible connector 50 by means of eyelet portion 12 without the need for an additional flexible connecting strand 13. In yet another alternative embodiment, virtually any other hook or clasp which comprises a closed loop with an openable portion could serve the purpose of fly closure fastener 10, provided it had a means for securing the first flexible elongate member 50.

Having thus described the invention with particular reference to the preferred forms thereof, it will be obvious that various changes and modifications can be made without departing from the spirit and scope of the present invention as defined by the impediment claims. In that regard, while the present invention is intended to be used in connection with an ornamental item such as jewelry or a purse or credit card holder, it could also be used to secure keys or any other small item which the owner might wish to protect. Accordingly, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. In combination, a garment having a waist-encircling portion, a belt loop affixed adjacent the waist-encircling portion, a fly operable to secure the waist-encircling portion, and a fly closure; and an article of jewelry comprising:

a fly closure fastener secured to the fly closure of the garment;

a belt loop fastener positioned over the belt loop of the garment;

a first elongate flexible member connecting the fly closure fastener and the belt loop fastener together;

an ornamental body; and a second elongate flexible member connecting the ornamental body to the belt loop fastener.

2. The garment and article of jewelry of claim 1 wherein said fly closure fastener comprises a closed loop.

3. The garment and article of jewelry of claim 1 wherein said fly closure fastener comprises a closed loop with an openable portion.

4. The garment and article of jewelry of claim 1 wherein said fly closure fastener comprises an eyelet portion connected to said first elongate flexible member.

5. The garment and article of jewelry of claim 1 wherein at least one of said first and second elongate flexible members comprises a chain.

6. The garment and article of jewelry of claim 5 wherein said chain comprises metal.

7. The garment and article of jewelry of claim 1 wherein at least one of said first elongate and second flexible members comprises a strand.

8. The garment and article of jewelry of claim 1 wherein said belt loop fastener comprises a base portion defining a generally flat contacting surface for the belt loop.

9. The garment and article of jewelry of claim 8 wherein said belt loop fastener further comprises a pair of branch portions depending from said base portion.

10. The garment and article of jewelry of claim 9 wherein said pair of branch portions have opposing free ends defining an opening narrower than a width of said base portion to thereby secure the belt loop within said belt loop fastener.

11. The garment and article of jewelry of claim 9 wherein each of said pair of branch portions has an eyelet portion at a free end thereof.

12. The garment and article of jewelry of claim 11 wherein said first elongate flexible member is connected to one of said eyelet portions, and wherein said second elongate flexible member is connected to the other eyelet portion.

13. The garment and article of jewelry of claim 12 wherein said first elongate flexible member has a length greater than a length of said second elongate flexible member.

14. The garment and article of jewelry of claim 1 wherein said ornamental body comprises a medallion.

15. The garment and article of jewelry of claim 1 wherein said ornamental body comprises a pouch.

16. In combination, a garment having a waist-encircling portion, a belt loop affixed adjacent the waist-encircling portion, a fly operable to secure the waist-encircling portion, and a fly closure; and an article of jewelry comprising:

a fly closure fastener secured to the fly closure of the garment;

a belt loop fastener positioned over the belt loop of the garment, the belt loop fastener comprising:

a base portion defining a generally flat contacting surface for the belt loop; and a pair of branch portions depending from said base portion;

a first elongate flexible member connecting the fly closure fastener and the belt loop fastener together;

an ornamental body; and a second elongate flexible member connecting the ornamental body to the belt loop fastener.

17. The garment and article of jewelry of claim 16 wherein said pair of branch portions have opposing free ends defining an opening narrower than a width of said base portion to thereby secure the belt loop within said belt loop fastener.

18. The garment and article of jewelry of claim 16 wherein each of said pair of branch portions has an eyelet portion at a free end thereof.

19. The garment and article of jewelry of claim 18 wherein said first elongate flexible elongate member is connected to one of said eyelet portions, and wherein said second elongate flexible member is connected to the other eyelet portion.

20. The garment and article of jewelry of claim 16 wherein said first elongate flexible member has a length greater than a length of said second elongate flexible member.

21. The garment and article of jewelry of claim 16 wherein said fly closure fastener comprises a closed loop.

22. The garment and article of jewelry of claim 16 wherein said fly closure fastener comprises a closed loop with an openable portion.

23. The garment and article of jewelry of claim 16 wherein said fly closure fastener comprises an eyelet portion connected to said first elongate flexible member.

24. The garment and article of jewelry of claim 16 wherein at least one of said first and second elongate flexible members comprises a chain.

25. The garment and article of jewelry of claim 16 wherein at least one of said first and second elongate flexible members comprises a strand.

26. The garment and article of jewelry of claim 16 wherein said ornamental body comprises a medallion.

27. The garment and article of jewelry of claim 16 wherein said ornamental body comprises a pouch.

28. A method of affixing an article of jewelry to a garment having a belt loop and a fly closure comprising the steps of:

providing an article of jewelry comprising:

a fly closure fastener;

a belt loop fastener having an opening therein;

a first elongate flexible member connecting the fly closure fastener and the belt loop fastener;

an ornamental body; and a second elongate flexible member connecting the ornamental body to the belt loop fastener;

securing the fly closure fastener to the fly closure of the garment; and positioning the belt loop fastener opening over the belt loop of the garment.

* * * * *